US009575469B2

(12) United States Patent
Liou et al.

(10) Patent No.: US 9,575,469 B2
(45) Date of Patent: Feb. 21, 2017

(54) WEARABLE WIRELESS ELECTRONIC DEVICE

(71) Applicant: Chiun Mai Communication Systems, Inc., New Taipei (TW)

(72) Inventors: Geng-Hong Liou, New Taipei (TW); Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 125 days.

(21) Appl. No.: 14/576,545

(22) Filed: Dec. 19, 2014

(65) Prior Publication Data

US 2015/0185707 A1 Jul. 2, 2015

(30) Foreign Application Priority Data

Dec. 30, 2013 (CN) ..... 2013 1 0743137

(51) Int. Cl.
*H01Q 1/12* (2006.01)
*G04R 60/02* (2013.01)
*G04R 60/14* (2013.01)

(52) U.S. Cl.
CPC ..... *G04R 60/02* (2013.01); *G04R 60/14* (2013.01)

(58) Field of Classification Search
CPC ..... H01Q 1/273; H01Q 7/00; H01Q 9/26; G04G 21/04
USPC ..... 343/718, 700 MS, 908, 878; 368/10, 47
See application file for complete search history.

(56) References Cited

U.S. PATENT DOCUMENTS

2004/0113819 A1* 6/2004 Gauthey ..... G06F 21/83 341/34
2010/0074059 A1* 3/2010 Hasumi ..... G04C 3/008 368/47
2011/0051561 A1* 3/2011 Fujisawa ..... G04G 5/002 368/47
2011/0102274 A1* 5/2011 Fujisawa ..... G04G 5/002 343/702

FOREIGN PATENT DOCUMENTS

CN 2904047 Y 5/2007
TW I269129 12/2006

* cited by examiner

*Primary Examiner* — Dameon E Levi
*Assistant Examiner* — Collin Dawkins
(74) *Attorney, Agent, or Firm* — Zhigang Ma

(57) ABSTRACT

A wearable wireless electronic device includes a watch dial and a hand module. The hand module includes a first hand and a second hand that are rotatably coupled to the watch dial. The first and second hands are configured to indicate current time and send/receive wireless signals. When the first and second hands rotate relative to the watch dial, the first and second hands are configured to display current time. When the first hand is positioned at a predetermined position substantially perpendicular to the second hand, the first and second hands are configured to send/receive wireless signals.

14 Claims, 4 Drawing Sheets

WEARABLE WIRELESS ELECTRONIC DEVICE

FIELD

The subject matter herein generally relates to wearable devices, and particularly to a wearable wireless electronic device having an antenna.

BACKGROUND

As wireless communication technology develops, most portable electronic devices have wireless communication function. The wireless communication needs a physical antenna to be the medium for transmitting or receiving signals. The antenna will cause an increase in volume, when the volume of the electronic device such as an electronic device worn on a wrist is small, it is difficult to keep the device with small and exquisite appearance.

BRIEF DESCRIPTION OF THE DRAWINGS

Implementations of the present technology will now be described, by way of example only, with reference to the attached figures.

DETAILED DESCRIPTION

Figure 1:
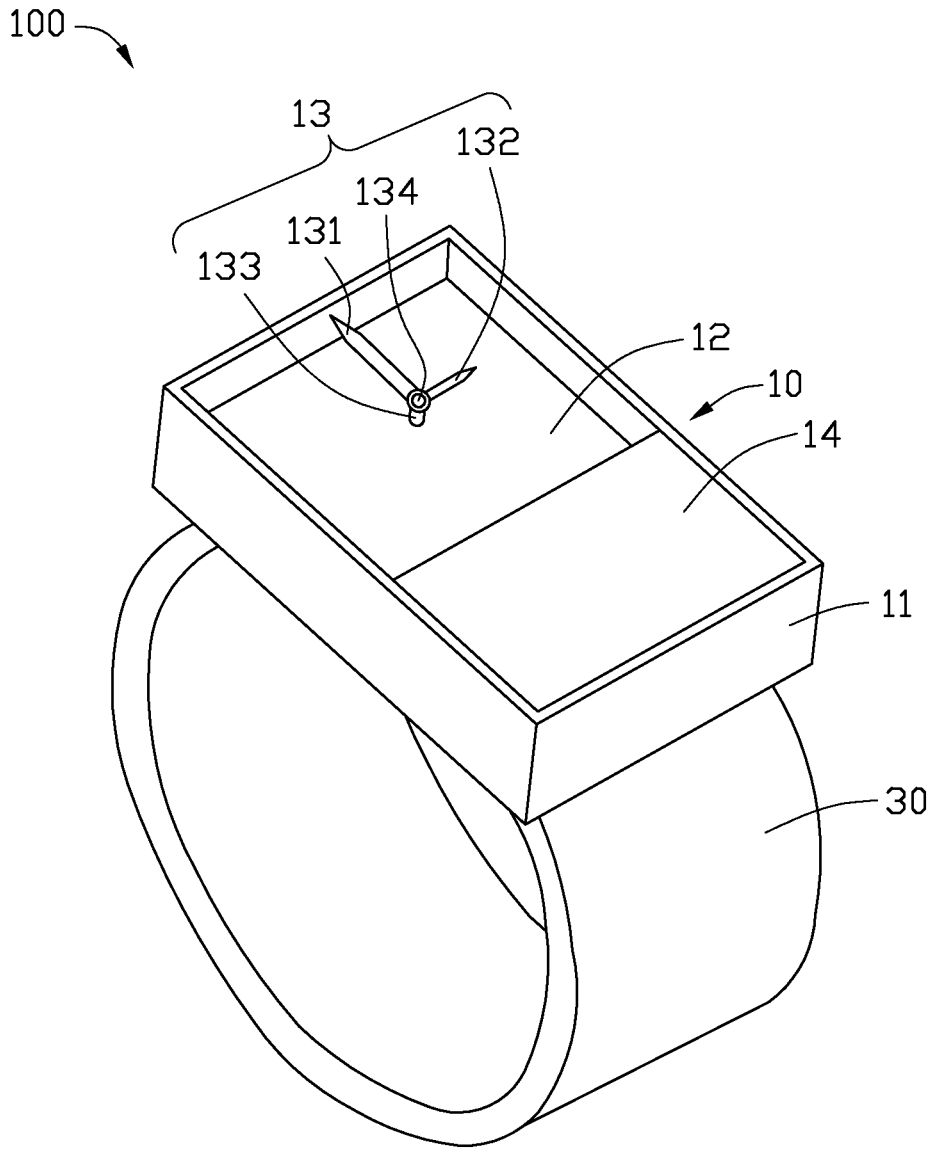
FIG. 1 is an isometric view of one embodiment of a wearable wireless electronic device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising" when utilized, means "including, but not necessarily limited to"; it specifically indicates open-ended inclusion or membership in the so-described combination, group, series and the like.

FIG. 1 illustrates an isometric view of one embodiment of a wearable wireless electronic device 100 having time indication and wireless communication functions. The wireless electronic device 100 includes a main body 10 and a strap 30 coupled to two ends of the main body 10. The strap 30 is configured to be worn on a wrist of a user. The main body 10 includes a casing 11, a watch dial 12, a touch screen 14 and a hand module 13. The watch dial 12 and the touch screen 14 are received in the casing 11 side by side.

The hand module 13 is configured to either indicate current time or serve as an antenna. The hand module 13 includes a first hand 131, a second hand 132, a first spindle 133 and a second spindle 134. The first and second hands 131, 132 are hour hand and minute hand, respectively. The first spindle 133 is coupled to the first hand 131. The second spindle 134 is coupled to the second hand 132. The first and second spindles 133, 134 are configured to drive the first and second hands 131, 132 to rotate, respectively, thereby displaying current time, and further configured to feed current signals to the first and second hands 131, 132 respectively. When the first and second hands 131, 132 rotate relative to the watch dial 12, the first and second hands 131, 132 display current time. When the first and second hands 131, 132 are motionless at a predetermined position, the first and second hands 131, 132 serve as an antenna to send/receive wireless signals. In at least one embodiment, when the first and second hands 131, 132 serve as the antenna, the first hand 131 is substantially perpendicular to the second hand 132. For example, when the first and second hands 131 and 132 serve as the antenna, the first and second hands 131 and 132 can be positioned at the three o'clock position as shown in FIG. 1.

The touch screen 14 is configured to indicate current time when the hand module 13 serve as the antenna, and further configured to select the function of the hand module 13 in response to a touch of a user.

Figure 2:
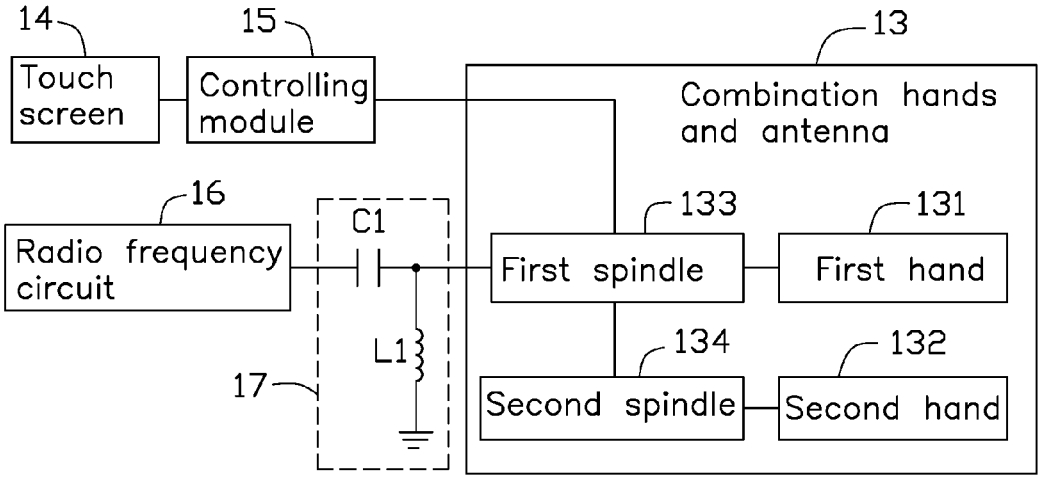
FIG. 2 is a block diagram of the wearable wireless electronic device as shown in FIG. 1.

FIG. 2 illustrates a block diagram of the wearable wireless electronic device 100 as shown in FIG. 1. The wearable wireless electronic device 100 is further provided with a controlling module 15, a radio frequency circuit 16, and an impedance matching circuit 17. The controlling module 15 is electronically coupled to the touch screen 14, and is configured to control operations of the first and second hands 131, 132 in response to commands input from the touch screen 14 by a user. In particular, when the controlling module 15 receives a first command from the touch screen 14, the controlling module 15 controls the first and second spindles 133 and 134 to drive the first and second hands 131, 132 to the predetermined position, and controls the first and second hands 131, 132 to remain motionless for a period of time to serve as an antenna to send/receive wireless signal. Alternatively, when the controlling module 15 receives a second command from the touch screen 14 during the first and second hands 131, 132 serve as the antenna, the controlling module 15 controls the first and second hands 131, 132 to move to a position in which the first and second hands 131, 132 indicate the current time, and further controls the first and second hands 131, 132 to rotate to keep indicating the current time.

The radio frequency circuit 16 is electronically coupled to the first and second hands 131, 132 through the impedance matching circuit 17. In particular, the impedance matching circuit 17 includes a capacitor C1 and an inductor L1. The radio frequency circuit 16 is grounded via the capacitor C1 and the inductor L1, a node between the capacitor C1 and the inductor L1 is electronically coupled to the first and second spindles 133, 134. Accordingly, the radio frequency circuit 16 can feed current signals to the first and second hands 131, 132 through the impedance matching circuit 17 and the first and second spindles 133, 134, to drive the first and second hands 131, 132 to send/receive wireless signals. The capacitor C1 with appropriate capacitance and the inductor L1 with appropriate inductance can ensure the hand module 13 resonates at a desired frequency band. In at least one embodiment, the capacitance value of the capacitor C1 is about 700 pF; the inductance value of the inductor L1 is about 1.5 nH. The first hand 131 is configured to receive/send wireless signal at a first frequency band from about 5200 MHz to about 5800 MHz (WiFi); the second hand 132 is configured to send/receive wireless signal at a second frequency band from about 2400 MHz to about 2484 MHz (Bluetooth).

Figure 3:
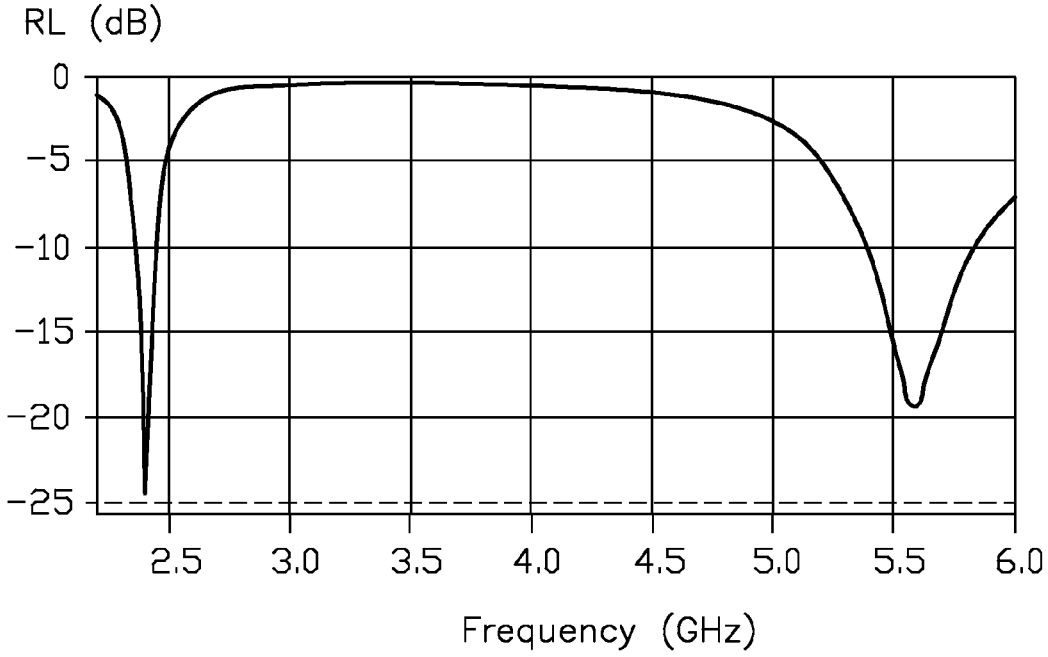
FIG. 3 is a diagram showing return loss ("RL") measurements of a hand module of the wearable wireless electronic device as shown in FIG. 1.

FIG. 3 illustrates a diagram showing return loss ("RL") measurements of the hand module 13 as shown in FIG. 1. It can be derived from FIG. 3 that RL is lower than −5 dB when the hand module 13 operates at the first frequency band from about 5200 MHz to about 5800 MHz, and the second frequency band from about 2400 MHz to about 2484 MHz.

Figure 4:
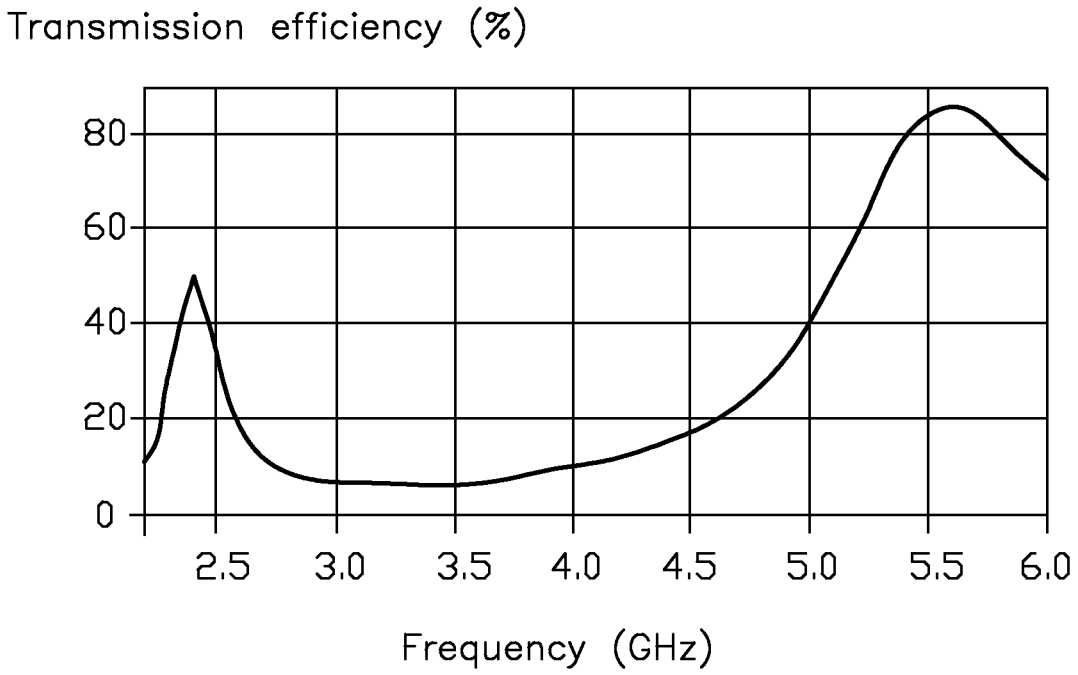
FIG. 4 is a diagram showing transmission efficiency measurements of a hand module of the wearable wireless electronic device as shown in FIG. 1.

FIG. 4 illustrates a diagram showing transmission efficiency measurements of the hand module 13 as shown in FIG. 1. A transmission efficiency of the hand module 13 at the first frequency band from about 5200 MHz to about 5800 MHz is in a range from about 60% to about 82%, and the transmission efficiency of the hand module 13 at the second frequency band from about 2400 MHz to about 2484 MHz is in a range from about 40% to about 50%. Thus, the hand module 13 can be utilized in WiFi and Bluetooth communication system with an exceptional communication quality In summary, the wearable wireless electronic device 100 utilizes the first and second hands 131, 132 to serve as antenna to send/receive wireless signals, thus there is no need to distribute additional volume to the antenna, and a small and exquisite appearance of the wearable wireless electronic device 100 can be achieved.

The embodiments shown and described above are only examples. Many details are often found in the art. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. A wearable wireless electronic device comprising:

a watch dial;

a hand module comprising a first spindle, a second spindle, a first hand and a second hand, the first spindle rotatably coupled to the watch dial, the second spindle rotatably coupled to the first spindle, the first spindle coupled to the first hand, the second spindle coupled to the second hand;

a radio frequency circuit; and an impedance matching circuit electronically coupled between the radio frequency circuit and the first spindle, the radio frequency circuit electrically coupled to the first and second hand through the impedance matching circuit and the first and second spindle;

wherein the first and second hands configured to indicate current time and further configured to send/receive wireless signals; when the first and second hands rotate relative to the watch dial, the first and second hands are configured to display current time; when the first hand and second hand are motionless at a predetermined position, the first hand and the second hand serve as an antenna to send/receive wireless signals, the radio frequency circuit feeds current signals to the first and second hand through the impedance matching circuit and the first spindle and second spindle, the first hand operates at a first frequency band, the second hand operates at a second frequency band, the impedance matching circuit enables the first hand and the second hand to resonate at a desired frequency band.

2. The wearable wireless electronic device of claim 1, further comprising a touch screen and a controlling module electronically coupled to the touch screen, wherein the touch screen is configured to control the operation of the hand module.

3. The wearable wireless electronic device of claim 2, wherein when the controlling module receives a first command from the touch screen, the controlling module is configured to control the first and second hands to move to the predetermined position, and control the first and second hands to remain motionless for a period of time to send/receive wireless signal; when the controlling module receives a second command from the touch screen during the first second hands serve as the antenna, the controlling module is configured to control the first and second hands to move to a position in which the first and second hands indicate the current time.

4. The wearable wireless electronic device of claim 2, wherein the touch screen is further configured to indicate current time when the hand module serve as an antenna.

5. The wearable wireless electronic device of claim 1, wherein the impedance matching circuit comprises a capacitor and an inductor, the radio frequency circuit is grounded via the capacitor and the inductor, a node between the capacitor and the inductor is electronically coupled to the first spindle.

6. The wearable wireless communication device of claim 5, wherein the first spindle is configured to rotate the first hand, the second spindle is configured to rotate the second hand; the node between the capacitor and the inductor is electronically coupled to the first hand through the first spindle, and electronically coupled to the second hand through the second spindle.

7. The wearable wireless electronic device of claim 1, wherein the first hand is an hour hand, the second hand is a minute hand.

8. A wearable wireless electronic device comprising:

a watch dial; and a hand module configured to selectively indicate current time or serve as an antenna, and comprising a first spindle, a second spindle, a first hand, a second hand, the second spindle coaxial with the first spindle, the first spindle rotatably coupled to the watch dial, the second spindle rotatably coupled to the first spindle, the first spindle coupled to the first hand, the second spindle coupled to the second hand:

a radio frequency circuit; and an impedance matching circuit electronically coupled between the radio frequency circuit and the first spindle, the radio frequency circuit electrically coupled to the first and second hand through the impedance matching circuit and the first and second spindle;

wherein the first spindle and second spindle are configured to rotate the first and second hands relative to the watch dial to indicate current time, and further configured to feed current signals to the first and second hands, respectively, to send/receive wireless signals; when the first and second hands rotate relative to the watch dial, the first and second hands are configured to display current time; when the first and second hands are motionless at a predetermined position, the first and second hands serve as an antenna to send/receive wireless signals, the radio frequency circuit feeds current signals to the first and second hand through the impedance matching circuit and the first spindle and second spindle, the first hand operates at a first frequency band, the second hand operates at a second frequency band, the impedance matching circuit enables the first hand and the second hand to resonate at a desired frequency band.

9. The wearable wireless electronic device of claim 8, wherein when the first and second hands are configured to send/receive wireless signals, the first hand is positioned substantially perpendicularly to the second hand.

10. The wearable wireless electronic device of claim 8, further comprising a touch screen and a controlling module electronically coupled to the touch screen, wherein the touch screen is configured to control the operation of the hand module through the controlling module in response to a touch of a user.

11. The wearable wireless electronic device of claim 10, wherein when the controlling module receives a first command from the touch screen, the controlling module is configured to control the first and second hands to move to the predetermined position, and control the first and second hands to remain motionless for a period of time to send/receive wireless signal; when the controlling module receives a second command from the touch screen during the first second hands serve as the antenna, the controlling module is configured to control the first and second hands to move to a position in which the first and second hands indicate the current time.

12. The wearable wireless electronic device of claim 10, wherein the touch screen is further configured to indicate current time when the hand module serve as an antenna.

13. The wearable wireless electronic device of claim 8, wherein the impedance matching circuit comprises a capacitor and an inductor, the radio frequency circuit is grounded via the capacitor and the inductor, a node between the capacitor and the inductor is electronically coupled to the first spindle.

14. The wearable wireless electronic device of claim 8, wherein the first hand is an hour hand, the second hand is a minute hand.

* * * * *